US007014491B1

(12) United States Patent
Simmel

(10) Patent No.: US 7,014,491 B1
(45) Date of Patent: Mar. 21, 2006

(54) ELECTRICAL CONNECTOR WITH IMPROVED LATCH

(75) Inventor: George M. Simmel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/051,844

(22) Filed: Feb. 4, 2005

(51) Int. Cl.
*H01R 13/627* (2006.01)

(52) U.S. Cl. ..... 439/353; 439/352

(58) Field of Classification Search ..... 439/352–353, 439/258, 357–358, 953
See application file for complete search history.

(56) References Cited

U.S. PATENT DOCUMENTS 6,071,141 A * 6/2000 Semmeling et al. ..... 439/353
6,454,589 B1 * 9/2002 Yeh ..... 439/352
6,540,542 B1 * 4/2003 Simmel ..... 439/352
6,648,666 B1 * 11/2003 Wu ..... 439/352
6,865,369 B1 * 3/2005 Semmeling et al. ..... 434/357
6,953,356 B1 * 10/2005 Hisamatsu et al. ..... 439/258

* cited by examiner

*Primary Examiner*—Michael C. Zarroli
(74) *Attorney, Agent, or Firm*—Stephen Z. Weiss

(57) ABSTRACT

An electrical connector is provided with a latching system for latching the connector to a mating connector and includes a dielectric housing having a forward mating end. A pair of latch arms are disposed at opposite sides of the housing and each latch arm includes a front latch end for latchingly engaging an appropriate latch on the mating connector. Each latch arm includes a rear engagement end and an intermediate pivot portion between the front and rear ends pivotally mounting the latch arm to the housing. Each latch arm further includes a biasing portion engageable with the housing to pivotally bias the latch arm about the pivot portion toward a latched position. A single actuating bracket is pivotally mounted on the housing and is engageable with the rear engagement ends of both latch arms for pivoting the latch arms against the biasing portions thereof toward an unlatched position. A single manually operable actuator is movably mounted on the housing for pivoting the single actuating bracket into engagement with the two latch arms.

24 Claims, 7 Drawing Sheets

ELECTRICAL CONNECTOR WITH IMPROVED LATCH

FIELD OF THE INVENTION

This invention generally relates to the art of electrical connectors and, particularly, to a flexible latching system for latching an electrical connector to a mating connecting device.

BACKGROUND OF THE INVENTION

A typical electrical connector includes some form of insulating or dielectric housing which mounts a plurality of conductive terminals. The connector is mated to a complementary mating connector or other connecting device which also has terminals for connection to the terminals of the first connector. Often, there is some form of interengaging latch means between the two connectors to hold the connectors in mated condition.

Flexible latching systems of the prior art require an operator to overcome the spring forces required to maintain the latches, such as latch hooks, of the mating connectors together. Typically, a pair of flexible latch arms are provided at opposite sides of one of the connectors. A pair of actuating latch buttons are provided at opposite sides of the connector to move or actuate the latch arms. Each latch button actuates one of the latch arms independent of the other, resulting in problems of applying correct balanced forces on each button. There is no simple latching system available which can be easily manufactured for allowing a single actuating latch button for operating both of the pair of latch arms. The present invention is directed to solving these problems and satisfying the need for an improved latching system for a pair of mating connectors or other connecting devices.

SUMMARY OF THE INVENTION

An object, therefore, of the invention is to provide an electrical connector with a new and improved latching system for latching the connector to a mating connector.

In the exemplary embodiment of the invention, the connector includes a dielectric housing having a forward mating end. A pair of latch arms are disposed at opposite sides of the housing and each latch arm includes a front latch end for latchingly engaging an appropriate latch on the mating connector. Each latch arm includes a rear engagement end and an intermediate pivot portion between the front and rear ends pivotally mounting the latch arm to the housing. Each latch arm further includes a biasing portion engageable with the housing to pivotally bias the latch arm about the pivot portion toward a latched position. A single actuating bracket is pivotally mounted on the housing and is engageable with the rear engagement ends of both latch arms for pivoting the latch arms against the biasing portions thereof toward an unlatched position. A single manually operable actuator is movably mounted on the housing for pivoting the single actuating bracket into engagement with the two latch arms.

As disclosed herein, each latch arm is stamped and formed of spring metal material and the biasing portion thereof comprises a leaf spring portion engageable with the housing. The housing includes a fulcrum portion engageable with the pivot portion of the latch arm.

According to one embodiment of the invention, the actuating bracket has a front end engageable with the rear engagement ends of the latch arms. A rear end of the bracket is engageable with the actuator, and an intermediate pivot portion of the bracket is disposed between the front and rear ends pivotally mounted to the housing.

According to another embodiment of the invention, the actuating bracket has a front end engageable with the rear engagement ends of the latch arms and a rear end pivotally mounted to the housing. An intermediate portion between the front and rear ends is engageable with the actuator.

According to one aspect of the invention, the housing includes a pair of housing halves. The actuating bracket is pivotally mounted to one housing half and the actuator is pivotally mounted on the other housing half. The actuator comprises a flexible portion integral with the other housing half. As disclosed herein, the actuator comprises an actuating button joined to the other housing half by a living hinge. The latch arms are mounted in a housing insert sandwiched between the two housing halves.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
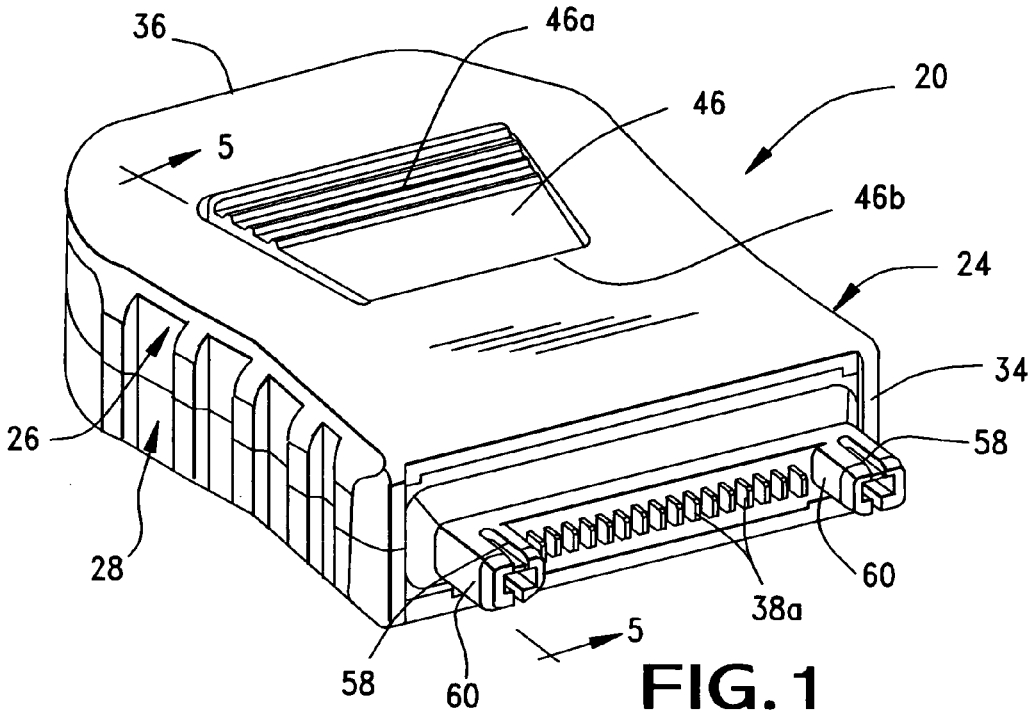
FIG. 1 is a perspective view looking at the mating end of an electrical connector according to the invention.

Referring to the drawings in greater detail, and first to FIGS. 1–4, a first embodiment of the invention is embodied in an electrical connector, generally designated 20 (FIG. 1), which includes a latching system for latching the connector to a mating connector or other connecting device, generally designated 22 in FIGS. 5–8 and described hereinafter. The connector includes a dielectric housing, generally designated 24, which is comprised of a top housing half, generally designated 26, and a bottom housing half, generally designated 28. Each housing half 26 and 28 is a one-piece structure unitarily molded of dielectric material such as plastic or the like. A housing insert, generally designated 30, is sandwiched between the two housing halves. It should be understood that such terms as "top", "bottom", "upper", "lower", "upwardly", "downwardly" and the like are used herein and in the claims hereof to provide a clear and concise understanding of the invention as viewed in the drawings, but these terms are not intended in any way to be limiting because the connector, obviously, is omni-directional in use and function.

Figure 3:
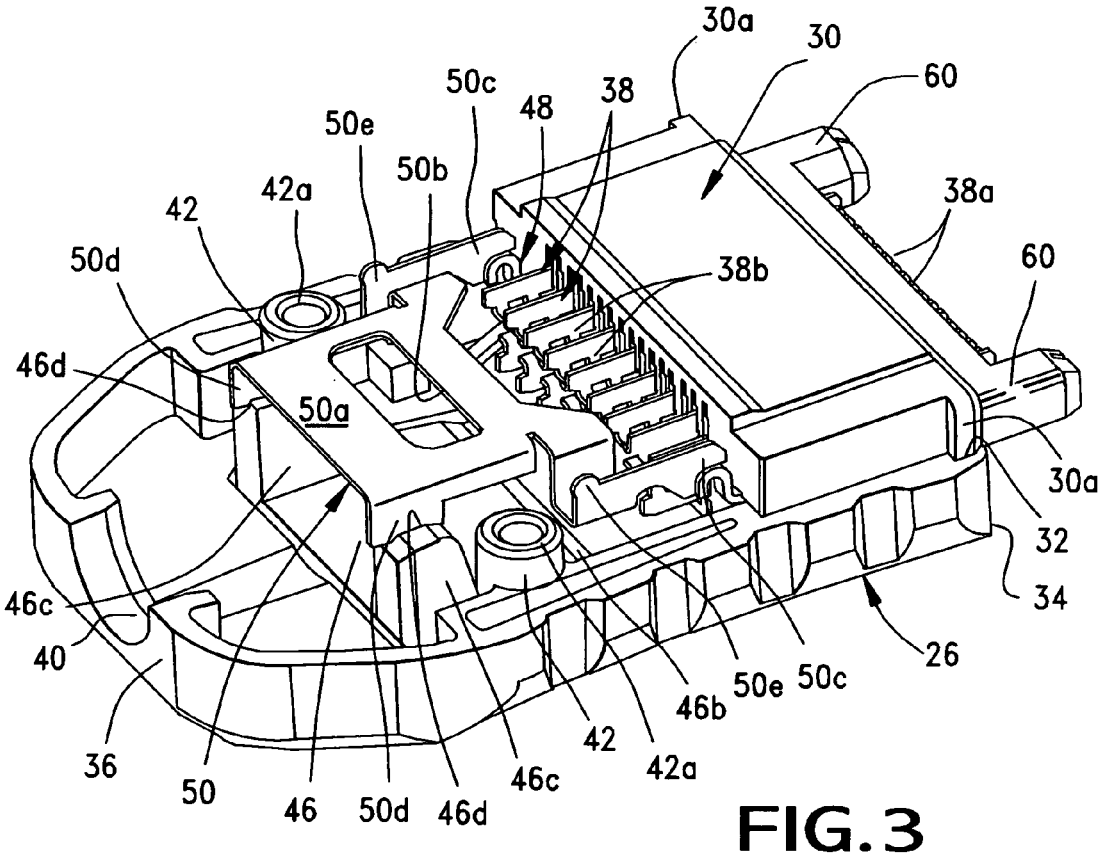
FIG. 3 is a perspective view of the connector of FIG. 1, turned upside-down and with the bottom housing half removed.
Figure 4:
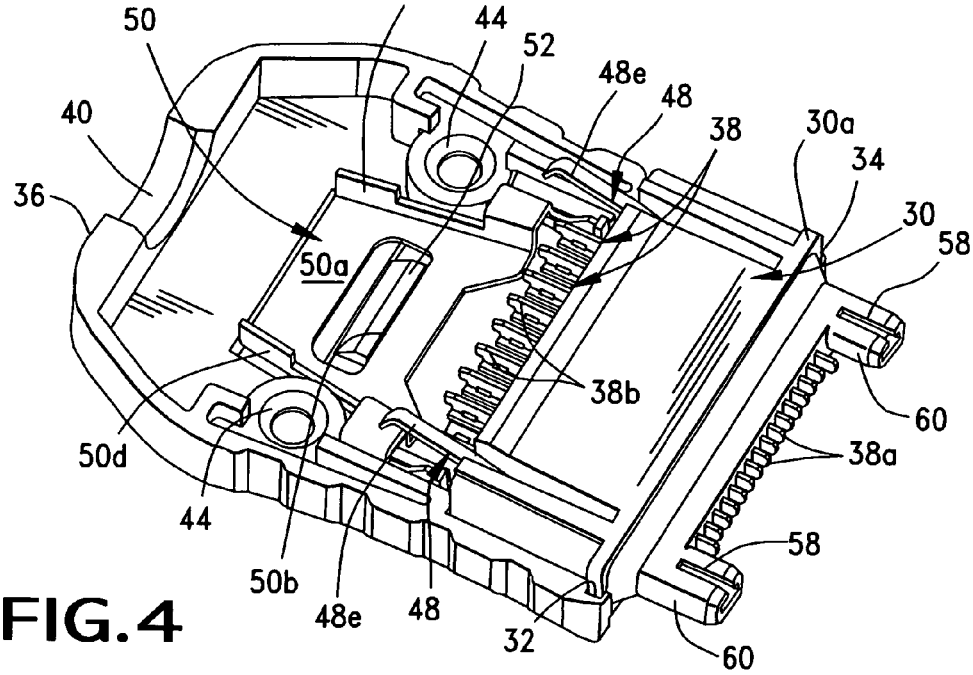
FIG. 4 is a view similar to that of FIG. 3, but of the top housing half.
Figure 5:
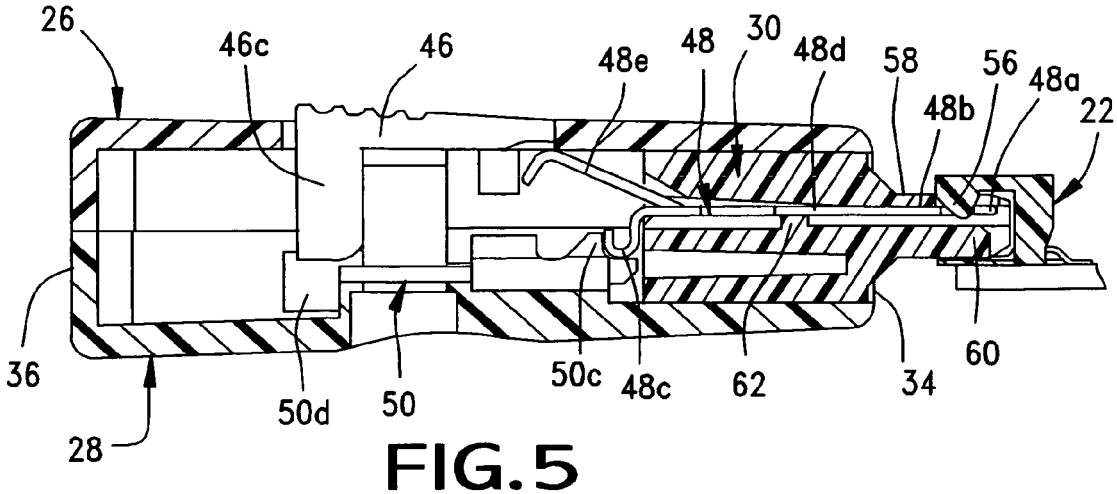
FIG. 5 is a vertical section taken generally along line 5—5 in FIG. 1, with the connector in latched condition.

With those understandings, FIGS. 3 and 4 show housing insert 30 in relation to top housing half 26 (FIG. 3) and bottom housing half 28 (FIG. 4). When the two housing halves are joined as shown in FIG. 1, the housing insert is sandwiched between the two housing halves.

The insert has a peripheral flange 30*a* which is positionable within grooves 32 near the forward mating ends of the housing halves. To that end, connector 20, as well as the two housing halves 26 and 28, includes a forward mating end 34 and a rear end 36.

Housing insert 30 is a one-piece structure molded of dielectric material such as plastic or the like and mounts a plurality of conductive terminals, generally designated 38. The terminals have front contact ends 38*a* and rear terminating ends 38*b*. The front contact ends project forwardly of the housing insert for engaging appropriate contacts of the mating connector or other connecting device 22. The terminating ends are connected to appropriate electrical wires from an electrical cable inserted into the housing through a rear hole 40 formed by the two housing halves.

Top housing half 26 includes a pair of interior posts 42 which have distal ends 42*a* which are insertable into a pair of interior sockets 44 of bottom housing half 28. The distal ends of the posts can be fixed within the sockets to fix the two housing halves together, as by a press-fit, an adhesive, ultrasonic welding or the like.

Generally, the latching system of the invention includes a manually operable actuator movable mounted on housing 24 and engageable by a finger or thumb of an operator. Specifically, and referring to FIGS. 1–3, the manually operable actuator is provided by a flexible actuating button 46 which has serrations 46*a* (FIG. 1) on the outside thereof. The actuating button is joined integrally with top housing half 26 by means of a living hinge 46*b* so that the actuating button can flex inwardly and outwardly relative to the housing. The actuating button has a pair of inwardly projecting posts 46*c* which are provided with slots 46*d* in the distal ends thereof.

In addition to actuating button 46, the latching system of the invention includes a pair of latch arms, generally designated 48, and a single actuating bracket, generally designated 50. The two latch arms 48 are pivotally mounted within housing insert 30, with the two latch arms located generally at opposite sides of the connector. The single actuating bracket 50 is pivotally mounted between the two housing halves 26 and 28. As will be seen hereinafter, the single actuating button 46 is effective to unlatch the two latch arms 48, through the single actuating bracket.

Figure 2:
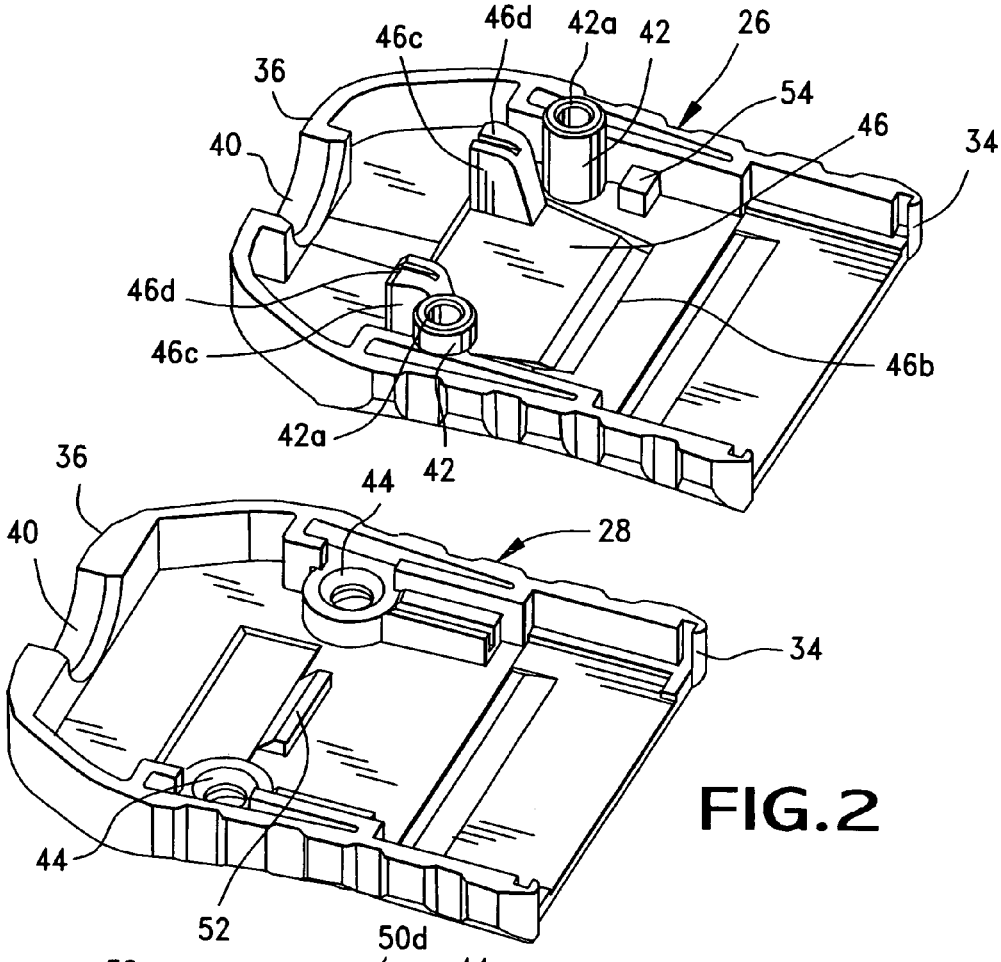
FIG. 2 is a perspective view looking at the insides of the two housing halves.

Actuating bracket 50 includes a generally flat plate-like body 50*a* which has a cut-out 50*b* that engages an abutment flange 52 on the inside of bottom housing half 28 as seen in FIGS. 2 and 4. The actuating bracket has a front end formed by a pair of actuating arms 50*c*, a rear end formed by a pair of flanges 50*d* and an intermediate pivot portion formed by a pair of pivot elbows 50*e*. Front actuating arms 50*c* engage rear engagement ends of latch arms 38 as will be seen hereinafter. Rear flanges 50*d* engage within slots 46*d* at the distal ends of posts 46*c* inside top housing half 26 as seen in FIG. 3. Pivot elbows 50*e* engage a pair of pivot bosses 54 (FIG. 2) inside top housing half 26. Body 50*a* and flanges 50*d* form a U-shaped structure to allow the electrical cable/wires to be inserted therethrough for termination to terminating ends 38*b* of terminals 38.

Referring to FIGS. 5–8, each latch arm 48 is a flexible component stamped and formed of spring metal material. Each latch arm includes a front latch end 48*a* having a latch hole 48*b* therethrough. Each latch arm has a rounded rear engagement end 48*c* and an intermediate pivot portion 48*d* between the front and rear ends. A biasing portion 48*e* projects rearwardly and upwardly from rear engagement end 48*c*. Latch hole 48*b* in front latch end 48*a* of each latch arm 48 receives a latch hook 56 at one side of mating connecting device 22. The latch hook projects downwardly through a slot 58 (FIG. 4) in one of a pair of latch posts 60 projecting forwardly from opposite ends of housing insert 30. The front latch ends 48*a* of the latch arms project into the latch posts of the housing insert.

Still referring to FIGS. 5–8, the rear engagement ends 48*c* of latch arms 48 engage actuating arms 50*c* of the single actuating bracket 50. Intermediate pivot portion 48*d* of each latch arm is held within housing insert 30 in engagement with an interior pivot flange 62. Biasing portion 48*e* of each latch arm comprises a leaf spring portion which is engageable with the inside of top housing half 26 to bias the latch arm about pivot portion 48*d* toward a latched position shown in FIGS. 5 and 7, with latch hooks 56 of the mating connector latchingly received within latch holes 48*b* at front latch ends 48*a* of the latch arms.

Figure 6:
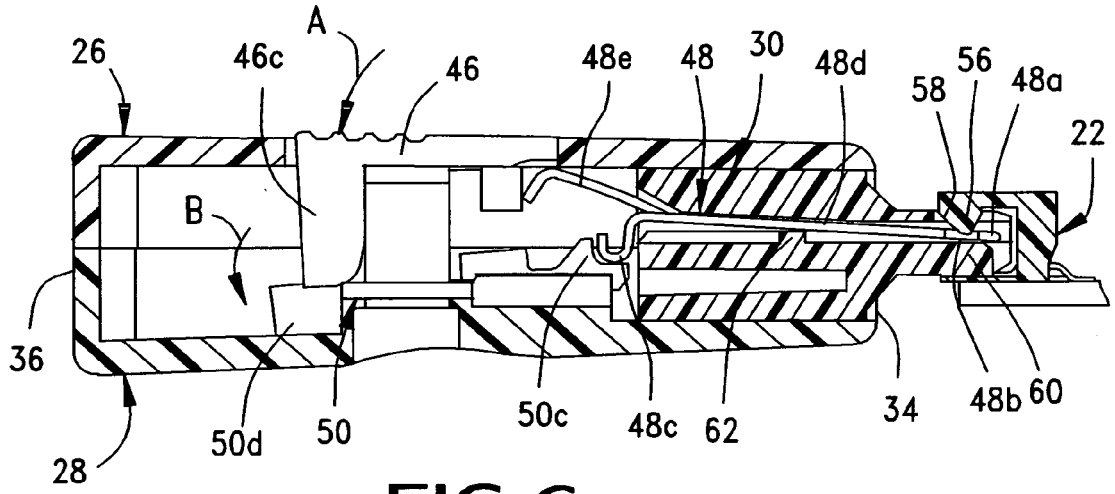
FIG. 6 is a view similar to that of FIG. 5, but with the connector in unlatched condition.
Figure 7:
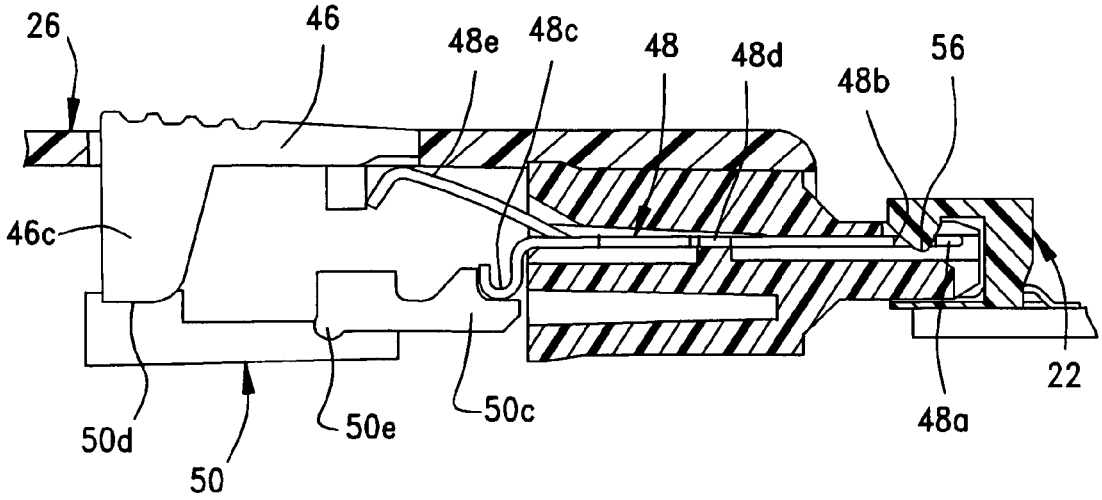
FIG. 7 is a view similar to that of FIG. 5, with the bottom housing half and portions of the top housing half removed.
Figure 8:
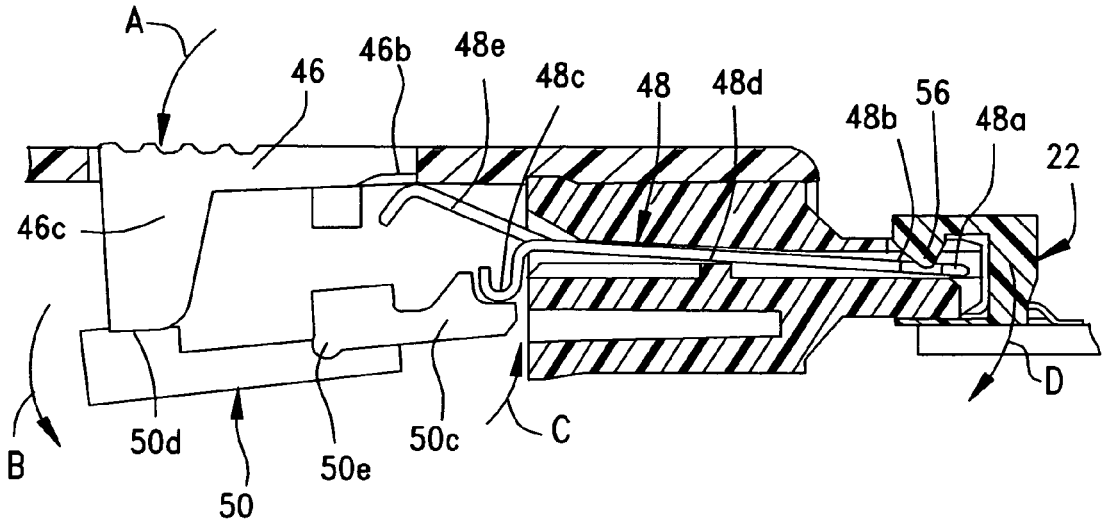
FIG. 8 is a view similar to that of FIG. 6, but with the bottom housing half and portions of the top housing half removed.
Figure 9:
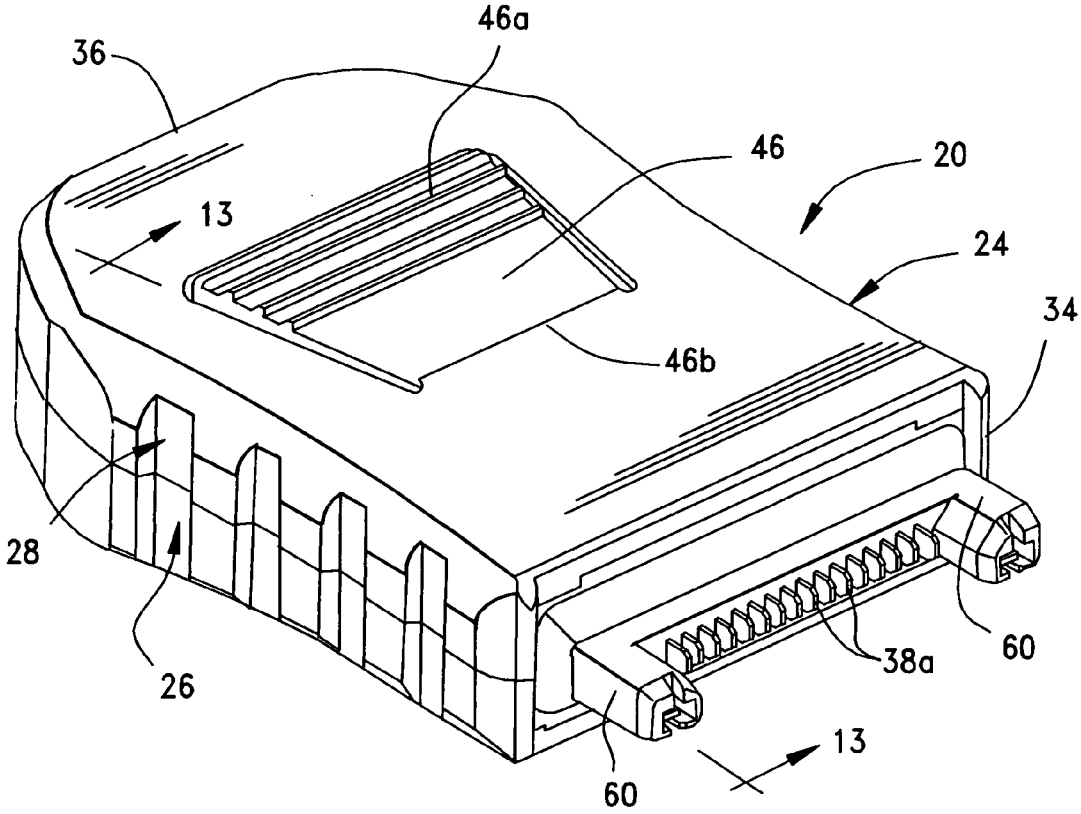
FIGS. 9–16 are views similar to that of FIGS. 1–8, but of an alternative embodiment of the invention.
Figure 10:
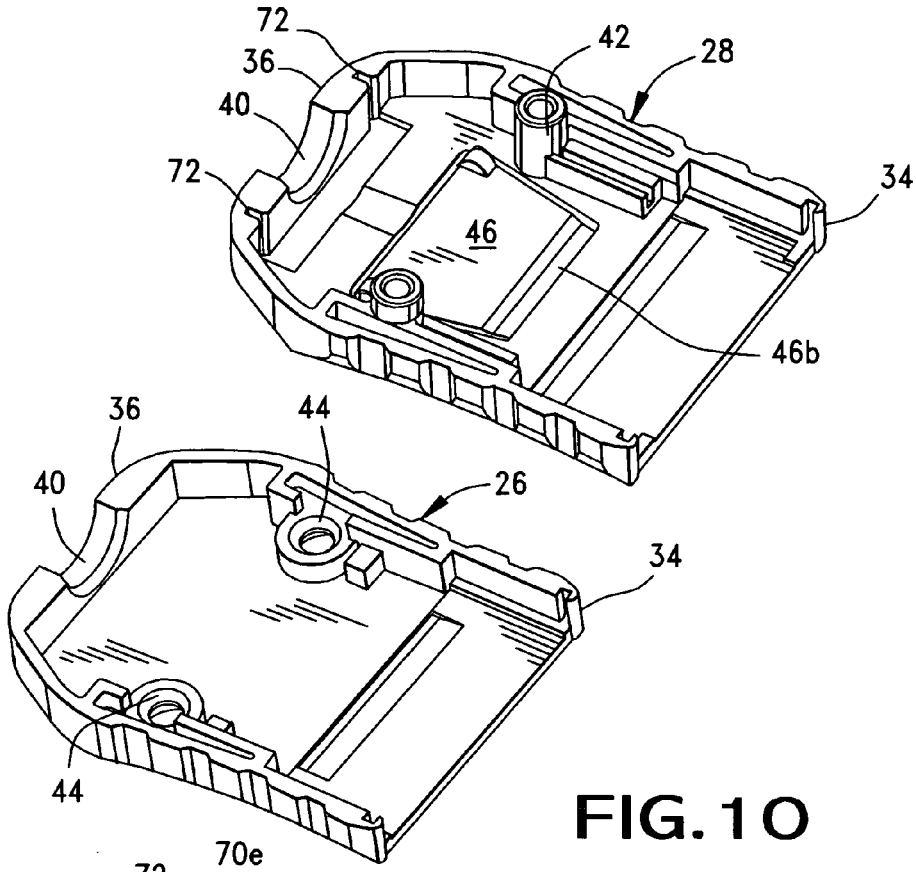

In order to unlatch connector 20 from mating connecting device 22, an operator pushes inwardly on actuating button 46 in the direction of arrow "A" (FIGS. 6 and 8). This pivots actuating bracket 50 about pivot elbows 50*e* downwardly in the direction of arrows "B", through the interengagement of posts 46*c* on the inside of the actuating button and flanges 50*d* on the actuating bracket. As the bracket pivots, actuating arms 50*c* at the front end of the bracket pivot upwardly in the direction of arrow "C" (FIG. 8). Through the engagement of actuating arms 50*c* of actuating bracket 50 with rear engagement ends 48*c* of latch arms 48, the rear ends of the latch arms also are pivoted upwardly in the direction of arrow "C", about pivot portions 48*d* of the latch arms, whereupon the front latch ends 48*a* of the latch arms are pivoted downwardly in the direction of arrow "D" (FIG. 8) and out of latching engagement with latch hooks 56 of the mating connecting device 22. During unlatching, energy is stored in leaf spring portion 48*e* of each latch arm, whereupon the release of actuating button 46 by the operator causes latch arms 48 to move back to their latched condition automatically under the biasing of leaf spring portions 48*e* of the latch arms.

FIGS. 9–16 correspond to FIGS. 1–8, respectively, and show an alternative embodiment of the invention. Because of the similarity of most of the components, like reference numerals are applied in FIGS. 9–16 corresponding to like components described above in relation to the first embodiment of FIGS. 1–8. Because of the similarity, a description of the like components and their functions will not be repeated.

In essence, in the alternative embodiment of FIGS. 9–16, connector 20 and mating connector 22 have been turned upside-down, and actuating button 46 has been integrally molded with bottom housing half 28 which now has become the top housing half as viewed in FIGS. 9–16. Nevertheless, the construction of housing insert 30, conductive terminals 38, latch arms 48 and mating connector 22 remain the same in both embodiments but in inverted orientations. The difference between the two embodiments resides primarily in a change in the single actuating bracket, because of the inversion of the connector.

Figure 11:
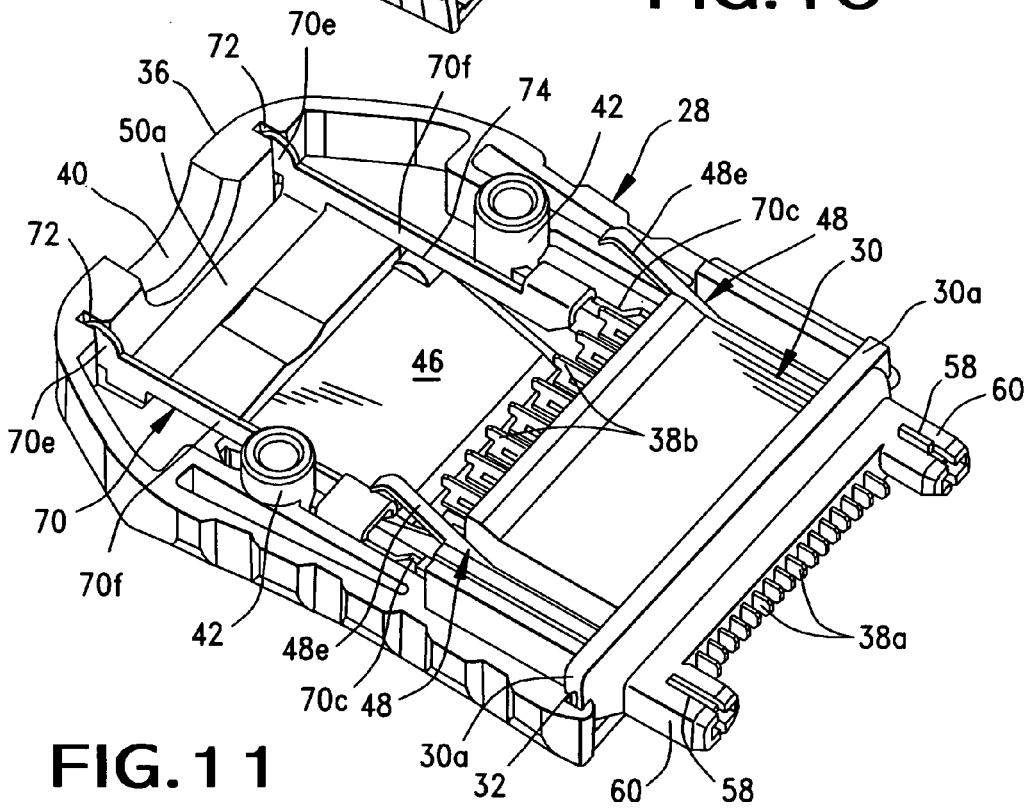
Figure 12:
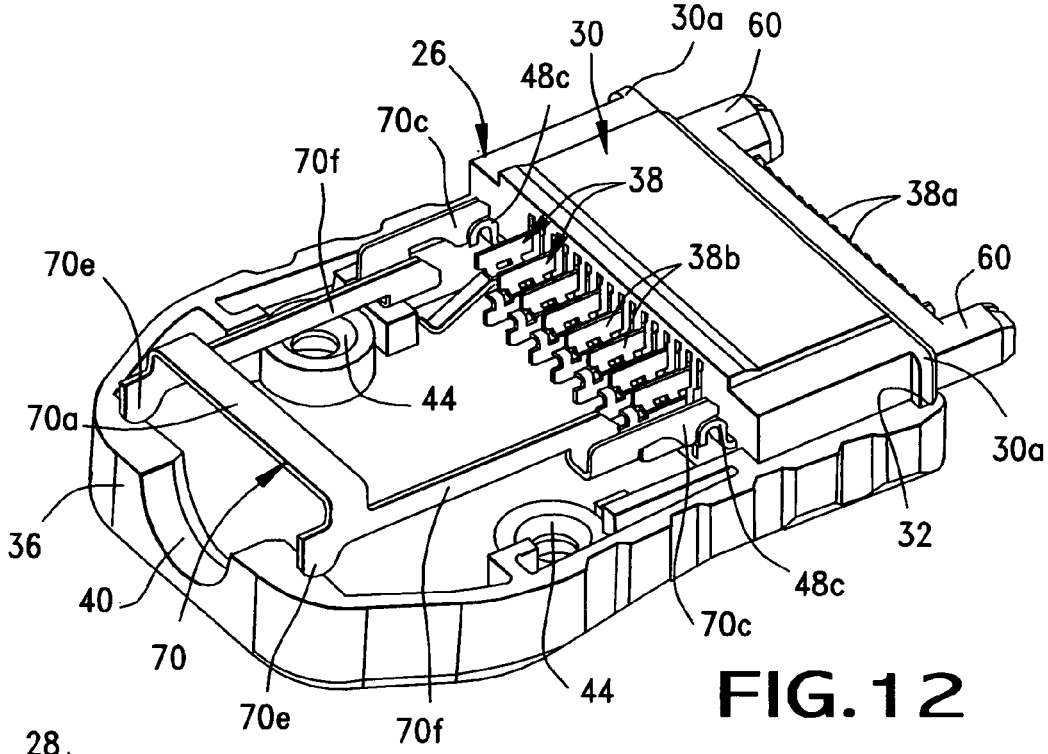
Figure 13:
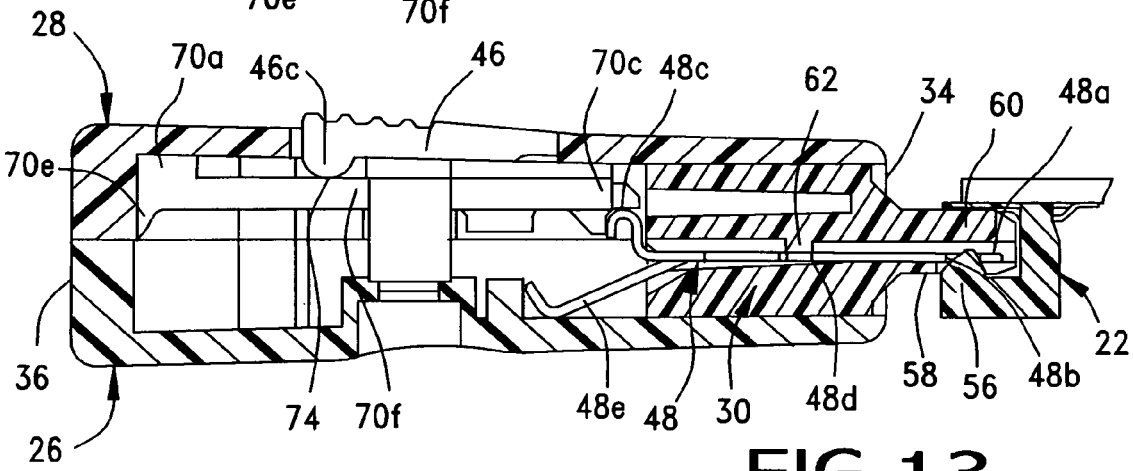
Figure 14:
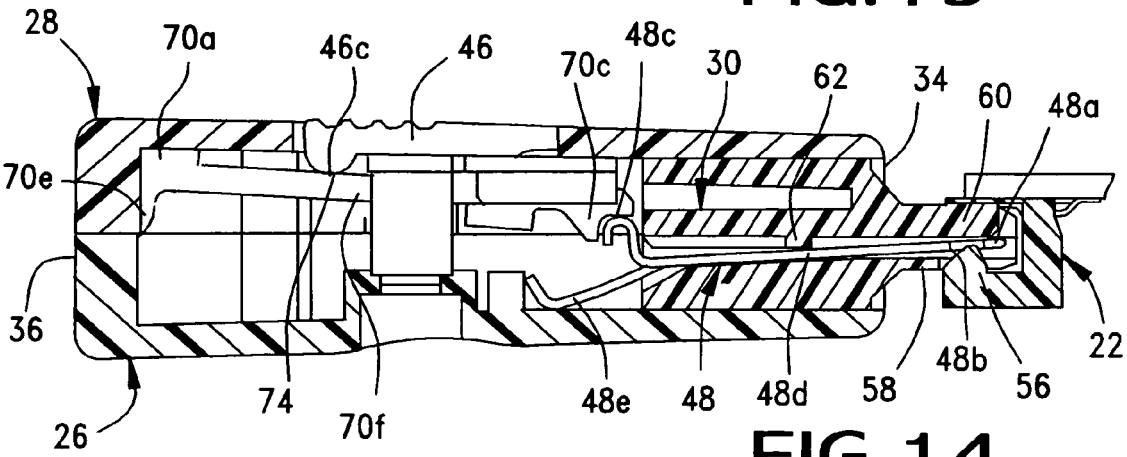
Figure 15:
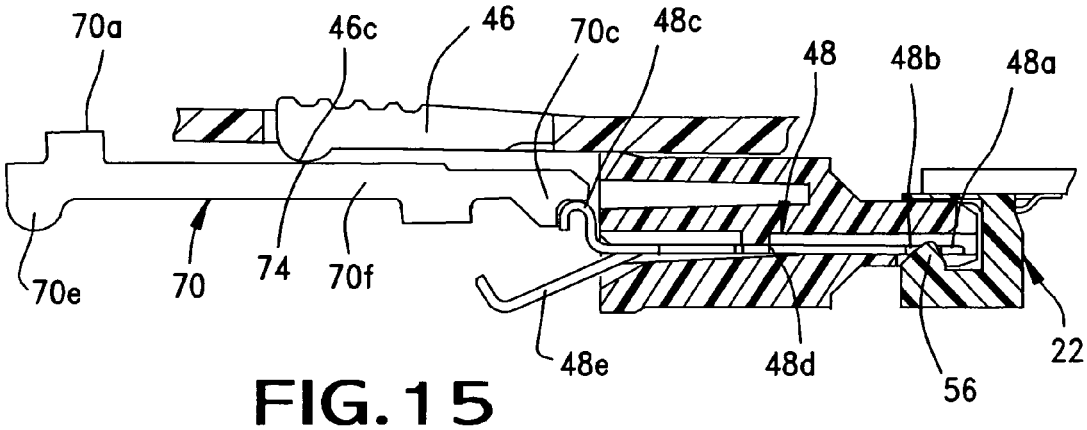
Figure 16:
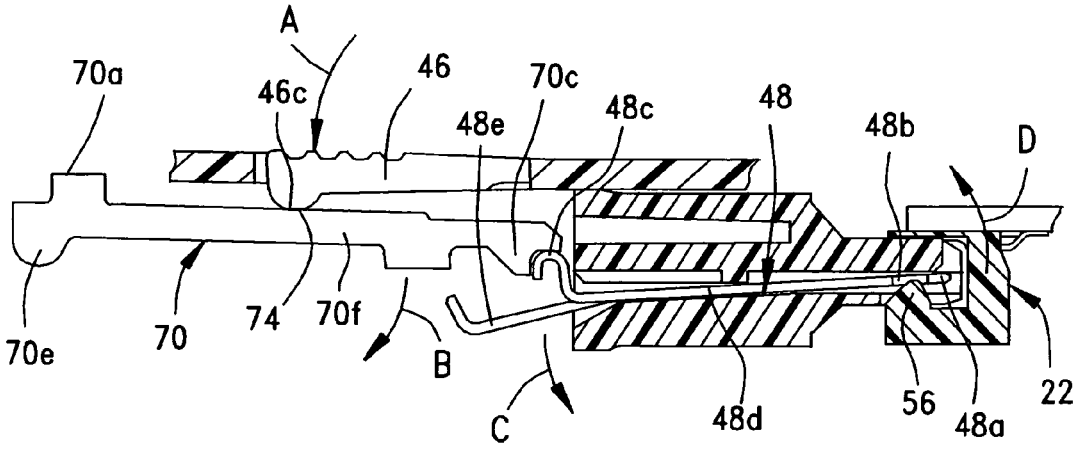

In particular, the second embodiment again includes a single actuating bracket, generally designated 70, which, again, includes a plate-like body 70*a* and a pair of forwardly projecting actuating arms 70*c* which define a front end of the bracket in engagement with rear engagement ends 48*c* of latch arms 48. However, actuating bracket 70 of the second embodiment includes a rear end defined by a pair of pivot portions 70*e* pivotally mounted within a pair of pivot slots 72 in housing half 28 as best seen in FIG. 11. As best seen in FIGS. 15 and 16, actuating button 46 in the second embodiment engages intermediate portions 70*f* of actuating bracket 70 at points 74 intermediate opposite ends of the actuating arms.

The latching system of the second embodiment of the invention shown in FIGS. 9–16 is best described in relation to FIG. 16. Specifically, the single actuating button 46 again is pushed inwardly by an operator in the direction of arrow "A". This causes the single actuating bracket 70 to pivot about pivot portions 70*e* downwardly in the direction of arrow "B". Through the engagement of actuating arms 70*c* of the single actuating bracket with rear engagement arms 48*c* of the two actuating arms 48, the rear ends of the actuating arms are pivoted downwardly in the direction of arrow "C" about intermediate pivot portions 48*d* of the actuating arms. Again, this causes the front latch ends 48*a* of the latch arms to pivot in the direction of arrow "D" so that latch hooks 56 of mating connector 52 are effectively moved out of latch holes 48*b* at the front ends of the latch arms.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector having a latching system for latching the connector to a mating connector, comprising:

a dielectric housing having a forward mating end;

a pair of latch arms at opposite sides of the housing and each latch arm including a front latch end for latchingly engaging an appropriate latch on the mating connector, a rear engagement end, an intermediate pivot portion between the front and rear ends pivotally mounting the latch arm to the housing, and a biasing portion engageable with the housing to pivotally bias the latch arm about the pivot portion toward a latched position;

a single actuating bracket pivotally mounted on the housing and engageable with the rear engagement ends of both latch arms for pivoting the latch arms against said biasing portions toward an unlatched position; and a single manually operable actuator movably mounted on the housing for pivoting the single actuating bracket into engagement with the two latch arms.

2. The electrical connector of claim 1 wherein each latch arm is stamped and formed of spring metal material, and said biasing portion comprises a leaf spring portion engageable with the housing.

3. The electrical connector of claim 1 wherein said housing includes a fulcrum portion engageable with the pivot portions of the latch arms.

4. The electrical connector of claim 1 wherein said actuating bracket has a front end engageable with the rear engagement ends of the latch arms, a rear end engageable with the actuator, and an intermediate pivot portion between the front and rear ends pivotally mounted to the housing.

5. The electrical connector of claim 1 wherein said actuating bracket has a front end engageable with the rear engagement ends of the latch arms, a rear end pivotally mounted to the housing, and an intermediate portion between the front and rear ends engageable with the actuator.

6. The electrical connector of claim 1 wherein said actuator comprises a flexible portion integral with the housing.

7. The electrical connector of claim 1 wherein said housing includes a pair of housing halves, said actuating bracket being pivotally mounted to one housing half and said actuator being pivotally mounted on the other housing half.

8. The electrical connector of claim 1 wherein said actuator comprises a flexible portion integral with the other housing half.

9. The electrical connector of claim 8 wherein said actuator comprises an actuating button joined to the other housing half by a living hinge.

10. The electrical connector of claim 7 wherein said latch arms are mounted in a housing insert sandwiched between the two housing halves.

11. The electrical connector of claim 1 wherein said housing includes a pair of housing halves, and said actuating bracket and said actuator both are pivotally mounted to one of the housing halves.

12. The electrical connector of claim 11 wherein said actuator comprises a flexible portion integral with the one housing half.

13. The electrical connector of claim 12 wherein said actuator comprises an actuating button joined to the one housing half by a living hinge.

14. The electrical connector of claim 11 wherein said latch arms are mounted in a housing insert sandwiched between the two housing halves.

15. An electrical connector having a latching system for latching the connector to a mating connector, comprising:

a dielectric housing having a forward mating end and including a pair of housing halves;

a pair of latch arms at opposite sides of the housing and each latch arm including a front latch end for latchingly engaging an appropriate latch on the mating connector, a rear engagement end, an intermediate pivot portion between the front and rear ends pivotally mounting the latch arm to the housing, and a biasing portion engageable with the housing to pivotally bias the latch arm about the pivot portion toward a latched position;

a single actuating bracket pivotally mounted on one of the housing halves and engageable with the rear engagement ends of both latch arms for pivoting the latch arms against said biasing portions toward an unlatched position; and a single manually operable actuator movably mounted on one of the housing halves for pivoting the single actuating bracket into engagement with the two latch arms.

16. The electrical connector of claim 15 wherein said latch arms are mounted in a housing insert sandwiched between the two housing halves.

17. The electrical connector of claim 15 wherein said actuating bracket is pivotally mounted to one housing half and said actuator is pivotally mounted on the other housing half.

18. The electrical connector of claim 15 wherein both said actuating bracket and said actuator are pivotally mounted on one of the housing halves.

19. The electrical connector of claim 15 wherein said actuator comprises a flexible portion integral with one of the housing halves.

20. The electrical connector of claim 19 wherein said actuator comprises an actuating button joined to the one housing half by a living hinge.

21. The electrical connector of claim 15 wherein each latch arm is stamped and formed of spring metal material, and said biasing portion comprises a leaf spring portion engageable with the housing.

22. The electrical connector of claim 15 wherein one of said housing portions includes a fulcrum engageable with the pivot portions of the latch arms.

23. The electrical connector of claim 15 wherein said actuating bracket has a front end engageable with the rear engagement ends of the latch arms, a rear end engageable with the actuator, and an intermediate pivot portion between the front and rear ends pivotally mounted to the housing.

24. The electrical connector of claim 15 wherein said actuating bracket has a front end engageable with the rear engagement ends of the latch arms, a rear end pivotally mounted to the housing, and an intermediate portion between the front and rear ends engageable with the actuator.

* * * * *